US008104201B2

(12) United States Patent
Cai et al.

(10) Patent No.: US 8,104,201 B2
(45) Date of Patent: Jan. 31, 2012

(54) METHOD AND DEVICE FOR AUTOMATICALLY REPLENISHING WATER FOR A BOILER IRON UNDER THE CONDITION OF CONTINUOUS STEAMING

(75) Inventors: Ruifeng Cai, Fujian (CN); Quanxi Liu, Fujian (CN)

(73) Assignee: Tsann Kuen (China) Enterprise Co., Ltd., Xiamen, Fujian (CN)

( * ) Notice: Subject to any disclaimer, the term of this patent is extended or adjusted under 35 U.S.C. 154(b) by 637 days.

(21) Appl. No.: 12/335,359

(22) Filed: Dec. 15, 2008

(65) Prior Publication Data

US 2009/0151206 A1 Jun. 18, 2009

(30) Foreign Application Priority Data

Dec. 14, 2007 (CN) ..... 2007 1 0144035

(51) Int. Cl.

| | |
|---|---|
| ***D06F 75/26*** | (2006.01) |
| ***D06F 75/40*** | (2006.01) |
| *G05B 7/00* | (2006.01) |
| *F24H 1/20* | (2006.01) |

(52) U.S. Cl. ..... 38/77.7; 38/1 C; 38/77.3; 700/282; 122/14.21

(58) Field of Classification Search ..... 38/77.7, 38/1 C, 77.3; 700/282; 122/14.21
See application file for complete search history.

(56) References Cited

U.S. PATENT DOCUMENTS

| | | | | |
|---|---|---|---|---|
| 4,414,037 | A * | 11/1983 | Friedheim | 134/35 |
| 5,832,639 | A * | 11/1998 | Muncan | 38/77.6 |
| 5,881,207 | A * | 3/1999 | DeBourg et al. | 392/401 |
| 6,647,931 | B1 * | 11/2003 | Morgandi et al. | 122/13.3 |
| 7,360,328 | B2 * | 4/2008 | Fung | 38/77.6 |
| 7,805,867 | B2 * | 10/2010 | Har et al. | 38/77.7 |

* cited by examiner

*Primary Examiner* — Ismael Izaguirre
(74) *Attorney, Agent, or Firm* — Kening Li; Pinsent Masons LLP

(57) ABSTRACT

A control method and device for the automatic water-replenishing for a boiler iron producing continuous steaming is disclosed. The method, which comprises a normally-closed pressure switch that can control power on/off of the boiler with respect to pressure and a normally-closed thermostat for maintaining a boiler thermostatic state, comprises the following steps: (1) determining whether the thermostat switch is off; if yes, step (3) is carried out, and if no, step (2) is carried out; (2) detecting whether the steam is being ejected; if yes, the electromagnetic valve will be opened to eject steam, while simultaneously pumping a relatively small amount of water into the boiler; (3) controlling the pump to pump a large amount of water into the boiler. According to a preferred embodiment of the present invention, in step (2), the quantity of water is slightly less than the quantity of water that is ejected as steam.

11 Claims, 2 Drawing Sheets

METHOD AND DEVICE FOR AUTOMATICALLY REPLENISHING WATER FOR A BOILER IRON UNDER THE CONDITION OF CONTINUOUS STEAMING

FIELD OF THE INVENTION

The present invention relates to a control method of automatic water-replenishing for a boiler iron and its device, more particularly to a control method of automatic water-replenishing for a boiler iron under the condition of uninterruptible steam and its device.

RELATED ART

With development of the society and advancement of people's living standards, the boiler iron has become a necessary small home appliance for the family. The boiler iron has working principle as follows: the water in the boiler is heated to be vaporized for ironing clothes. By the working principle, the water must be added into the boiler continually to be vaporized to prevent the boiler out of water.

The boiler iron has a traditional water-replenishing mode: if water-replenishing is needed, users open the lid of the boiler and add water into the boiler directly. If there is a high pressure in the boiler, the lid can't be opened until the temperature and the pressure falls, so this boiler iron is not convenient for water-replenishing.

Aiming above-mentioned disadvantages, people advance an improved water-replenishing mode: the water is pumped into the boiler by pump and by detached water tank. In the early stage this improved mode adopts mechanical type, which can pump a large amount of water into the boiler once after tripping of a normally closed thermostat with a high set temperature, such as 200 g water being pumped into the boiler with 1000 g capability. Although this mode can overcome the disadvantage that the lid can't be opened easily under the condition of high pressure of the boiler, that a large amount of water is pumped into the boiler once will result in sharp falling of the temperature of the boiler and interruption of steam supply, and people must wait for a long time to use the iron again.

Aiming the disadvantages of the early boiler with detached water tank, people advance an improved control method. A water-level sensor is set at some height of the boiler for sensing the water volume in the boiler. The water will be added into the boiler as long as the water in the boiler is less than a set point. Although this mode can control the water volume in the boiler directly and can prevent interruption of steam supply of the mechanical water-replenishing of above-mentioned detached water tank, it has a complex art to add a water-level sensor in the boiler and has a high cost.

SUMMARY OF THE INVENTION

The present invention provides a control method of automatic water-replenishing for a boiler iron under the condition of uninterruptible steam and its device, which overcomes the shortcomings of known water-replenishing modes in the related art.

The present invention adopts technical solution one to overcome the shortcomings as follows.

A control method of automatic water-replenishing for a boiler iron under the condition of continuous steaming, which comprises a normally-closed pressure switch that can control power on/off of the boiler according to the pressure in the boiler and a normally-closed thermostat for keeping the boiler in a thermostatic state, the method comprising:

(1) determining whether the thermostat switch is off; if yes, step (3) is carried out, and if no, step (2) is carried out;

(2) detecting whether the steam is needed to be ejected; if yes, opening the electromagnetic valve to eject steam, while at the same time pumping a relatively small amount of water into the boiler by controlling the pump; and (3) controlling the pump to pump a relatively large amount of into the boiler.

According to a preferred embodiment of the present invention, wherein in step (2), the quantity of water of pumped into the boiler is slightly less than the quantity of water ejected as steam.

According to a preferred embodiment of the present invention, wherein in step (2), the detecting of whether the steam is needed to be ejected is by detecting the signal of the control key of the electromagnetic valve.

According to a preferred embodiment of the present invention, wherein in step (3), the water is pumped into the boiler by pumping a relatively small mount of water mulpile times via controlling the pump, to ensure that the replenished water can be adequately vaporized.

According to a preferred embodiment of the present invention, wherein the normally-closed pressure switch and the normally-closed thermostat are coupled in such a way that when the temperature and the pressure in the boiler both rise at the same time, the pressure switch is cut off first if needed.

The present invention adopts technical solution two to overcome the shortcomings as follows.

A control method of automatic water-replenishing of a boiler iron under the condition of continuous steaming, which comprises a normally-closed pressure switch that can control power on/off of the boiler according to the pressure in the boiler and a temperature sensor that can sense the temperature of the exterior of the boiler, the method comprising the following steps:

(1) comparing the real-time temperature obtained from the temperature sensor with the set point at which the pressure switch is turned off; if the real-time temperature is higher than the set point, step (2) is carried out; if the real-time temperature is lower than the set point no water-replenishing is carried out;

(2) controlling the pump to pump water into the boiler.

According to a preferred embodiment of the present invention, wherein in step (2) the pump is controlled to pump a relatively small amount of water into the boiler.

According to a preferred embodiment of the present invention, wherein an amount of water-to be replenished is calculated based on a temperature difference between the real-time temperature and a set point, then the pump is controlled to pump the calculated amount of water into the boiler.

The present invention adopts technical solution three to overcome the shortcomings as follows.

A control method of automatic water-replenishing of a boiler iron under the condition of continuous steaming, which comprises a normally-closed pressure switch that can control power on/off of the boiler according to the pressure in the boiler, a normally-closed thermostat for keeping the boiler in a thermostatic state a temperature sensor that can sense the temperature of the exterior of the boiler, wherein the method comprises:

(1) judging whether the thermostat switch is off; if yes, step (4) is carried out; if no, step (2) is carried out;

(2) comparing the real-time temperature detected by the temperature sensor with a set point when the pressure switch is off; if the real-time temperature is higher than the set point, step (3) is carried out, if the real-time temperature is lower than the set point no water-replenishing is carried out;

(3) controlling the pump to pump water into the boiler;

(4) controlling the pump to pump a relatively large amount of water into the boiler.

The present invention adopts technical solution four to overcome the shortcomings as follows.

A control device of automatic water-replenishing of the boiler iron under the condition of uninterruptible steam, which comprises a normally closed pressure switch that can control power on/off of the boiler according to the pressure in the boiler and a normally closed thermostat for keeping the boiler in a thermostatic state, at least comprises a judging unit and a detecting module;

the judging unit is used to judge whether the thermostat switch is off; if yes, controlling the pump to pump a relatively large amount of water into the boiler, or else carrying out the detecting module;

the detecting module is used to detect whether the steam can be ejected; if yes, opening the electromagnetic valve to eject the steam and controlling the pump to pump a relatively small amount of water into the boiler.

The present invention adopts technical solution five to overcome the shortcomings as follows.

A control device for automatic water-replenishing of a boiler iron which can operate under the condition of continuous steaming, which comprises a normally-closed pressure switch that can control power on/off of the boiler according to the pressure in the boiler, and a temperature sensor that can sense the temperature of the exterior of the boiler, wherein the control device comprises a judging unit;

wherein the judging unit compares the real-time temperature detected by the temperature sensor with a set point when the pressure switch is off; and wherein if the real-time temperature is higher than the set point, the judging unit controls the pump to pump water into the boiler.

The present invention has advantages as follows. The present invention can detect the quantity of water in the boiler by the pressure switch and the thermostat/the temperature sensor, then control the pump to pump water into the boiler by the detecting result, which overcomes the shortcomings in related art, and has virtues as follows. Firstly, the present invention controls the pump to pump water into the boiler by automatic detecting, which provides a simple and inexpensive design of a boiler iron with a detached water tank, that has an automatic water-replenishing function, and is simple, convenient, fast and safe. Secondly, the present invention adopts thermostat and pressure switch (pressure switch and temperature sensor) and the detecting of the electronic control board without that a water-level sensor gets into the boiler, which has a simple art and a low cost. Thirdly, the present invention prevents the interruption of steam supply under the condition of that there is some water in the water tank.

BRIEF DESCRIPTION OF THE DRAWINGS

The present invention will be further described according to the drawings and embodiments.

DETAILED DESCRIPTION OF THE PREFERRED EMBODIMENT

Embodiment 1

Figure 1:
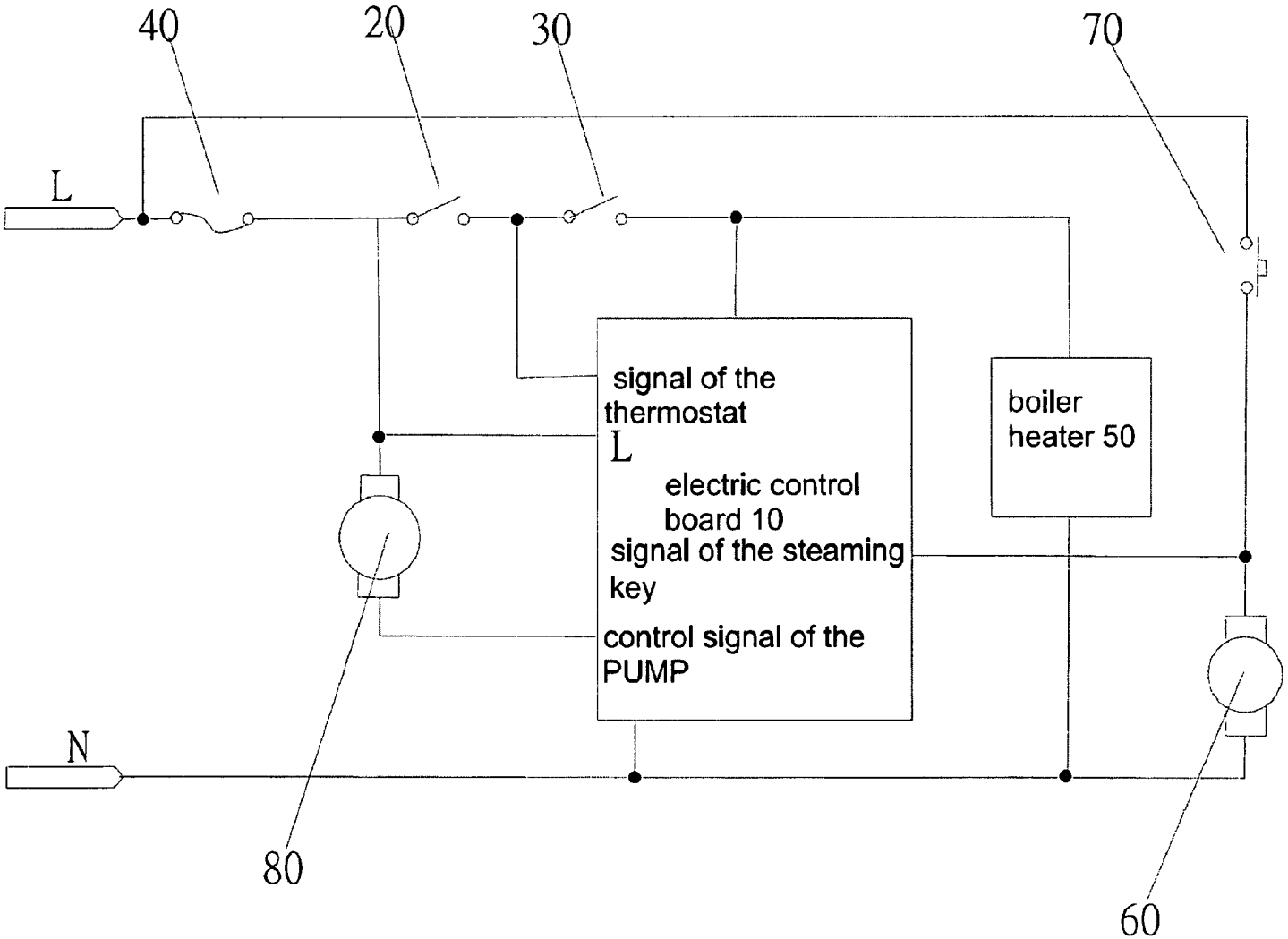
FIG. 1 is a controlling circuit diagram of embodiment 1.

A control method of automatic water-replenishing for a boiler iron under the condition of uninterruptible steam, which comprises a normally-closed pressure switch that can control power on/off of the boiler according to the pressure in the boiler and a normally-closed thermostat for keeping the boiler in a thermostatic state. Choosing parameters of the thermostat and the pressure switch to make the normally closed pressure switch and the normally closed thermostat are coupled in such a way that when the temperature and the pressure in the boiler both rise at the same time, the pressure switch is cut off first if needed.

The work principle of the method will be described before describing the embodiment for readers can understand the invention further. When there is a relatively large amount of water in the boiler, accompanying with the rising of temperature the water in the boiler is vaporized, which will result in the rising of pressure. The pressure arrives at its set point ahead of schedule (namely the pressure switch is off and the thermostat is not off) and the thermostat keeps at its normally closed state. When there is a relatively small amount of water in the boiler (the water in the boiler decreases to some degree), the pressure in the boiler will rise along with the rising of the temperature. But because there is too little water in the boiler, when the temperature rises to the set point of the thermostat, the pressure still can't arrive at the set point of the pressure switch (namely the thermostat is off and the pressure switch is not off). This is the condition that the temperature arrives at the set point of the thermostat ahead of schedule and the pressure switch is not off on account of lack of water in the boiler. That the thermostat is always on will be judged that the boiler is at its normal heating state and there is still some water in the boiler. The quantity of water in the boiler can be judged by detecting the signals of the thermostat and the pressure switch as following tables.

| Number | Thermostat | Pressure switch | Indicating state |
|---|---|---|---|
| 1 | on | on | the pressure doesn't arrive at its set point, normal heating state |
| 2 | on | off | there is some water in the boiler, the pressure arrives at its set point |
| 3 | off | on | lack of water in the boiler, water-replenishing is needed |
| 4 | off | off | lack of water in the boiler, water-replenishing is needed |

The method of automatic water-replenishing comprises steps as follows:

(1) getting the signal of the thermostat and determining whether the thermostat switch is off; if yes, step (3) is carried out, and if no, step (2) is carried out;

(2) detecting whether the steam is needed to be ejected by detecting the signal of the control key of the electromagnetic valve (by electronic control board detecting the signal of the control key of the electromagnetic valve, as long as detecting out the steam the control key is pressed); if yes, opening the electromagnetic valve to eject steam, while at the same time pumping a relatively small amount of water into the boiler by controlling the pump; and (3) controlling the pump to pump a relatively large amount of into the boiler, in practice the water is pumped into the boiler by pumping a relatively small mount of water mulpile times via controlling the pump, namely the large amount of water is pumped into the boiler by pumping a relatively small mount of water mulpile times via controlling the pump to ensure that the replenished water can be adequately vaporized.

In above-mentioned step (2), the quantity of water of pumped into the boiler is slightly less than the quantity of water ejected as steam. This is decided by following reasons: the state that the boiler is full of water can't be judged by the logic of above table and the signal of known sensing switch without the water-level sensor, so if the water that is pumped into the boiler is more than the quantity of steam that is ejected, it will result in two disadvantages as follows: on one hand it will affect the temperature of the boiler, and affect the quantity of steam and preheating time, so as to waste electric energy; on the other hand the water in the boiler will increase more and more so that the boiler is full of water, which will affect the using of the boiler. If the water that is pumped into the boiler is slightly less than the quantity of steam that is ejected, it not only can assure that the quantity of steam is stable, but also can prolong the time that the state of lack of water of the boiler appears; even if the boiler is closed to the state of lack of water, if only there is water in the water tank the boiler can ensure a small amount of steam and a uninterruptible steam.

In above-mentioned large amount of water-replenishing step of step (3), the state of lack of water of the boiler can be judged if only the thermostat is cut off once, here the temperature of the boiler arrives at its max. The control board must assure that the water that is replenished into the boiler can be adequately vaporized such as 20 g to maintain the short-time normal steam requirement, so it had better not replenish a large amount of water into the water tank once. If the state of lack of water of the boiler is confirmed, the control board will control the pump to replenish water into the boiler by pumping a relatively small mount of water mulpile times via controlling the pump, for example, 200 g water is divided into ten shares and is replenished into the boiler averagely, which can ensure a stable steaming and no interruption of steam supply.

A control device of automatic water-replenishing for a boiler iron under the condition of uninterruptible steam, which comprises a normally closed pressure switch that can control power on/off of the boiler according to the pressure in the boiler and a normally closed thermostat for keeping the boiler in a thermostatic state. Choosing parameters of the thermostat and the pressure switch to make the normally closed pressure switch and the normally closed thermostat are coupled in such a way that when the temperature and the pressure in the boiler both rise at the same time, the pressure switch is cut off first if needed. In the present embodiment the control device is a control board, which is used to detect and get the signals of the pressure switch and the thermostat and the electromagnetic valve (that is used to control the signal of the control key) and to give orders to control pump. The device at least comprises a judging unit and a detecting module. The judging unit is used to get the signal of the thermostat and to judge whether the thermostat switch is off; if yes, controlling the pump to make a relatively large amount of water be pumped into the boiler, or else the detecting module is carried out. The detecting module is used to get the signal of the electromagnetic valve and to detect whether the steam can be ejected; if yes, opening the electromagnetic valve to eject the steam and controlling the pump to make a relatively small amount of water be pumped into the boiler.

The circuit diagram of above-mentioned boiler can be seen in FIG. 1, which comprises a control board 10, a pressure switch 20, a thermostat switch 30, a fuse 40, a boiler heater 50, an electromagnetic valve 60, a steaming key 70 and a pump 80. The technicians in the present field can design the detailed circuit without creationary works, so the detailed circuit will not be described.

Embodiment 2

A control method of automatic water-replenishing for a boiler iron under the condition of uninterruptible steam, which comprises a normally closed pressure switch that can control power on/off of the boiler according to the pressure in the boiler and a temperature sensor, such as NTC that can sense the temperature of the exterior of the boiler.

The work principle of the method will be described before describing the embodiment for readers can understand the invention further. The quantity of water in the boiler can be judged by the temperature detected by the temperature sensor and the signal of the pressure switch, whose principle is as follows: the water is heated to be vaporized, and the pressure in the boiler will rise along with the rising of the temperature in the boiler, but the pressure can only arrive at the set point of the pressure switch on account of the pressure switch (then the pressure switch cuts the power, the pressure will not rise greatly, and the pressure will fall after its peak value); in above course, the different quantities of water in the boiler correspond with different temperature when the pressure in the boiler arrives at the set point of the pressure switch. The less water in the boiler, the higher temperature when the pressure in the boiler arrives at the set point of the pressure switch. For instance, if there is 200 g water in the boiler, the temperature when the pressure in the boiler arrives at 3.5 bar is 140° C.; if there is 20 g water in the boiler, the temperature when the pressure in the boiler arrives at 3.5 bar is 155° C. By this principle, the quantity of water in the boiler can be judged by detecting the temperature of the boiler at the moment that the pressure switch is cut off, so when there is also some water such as less than 50 g in the boiler, the water will be pumped into the boiler at once by pumping a relatively small mount of water mulpile times via controlling the pump, which can assure that there is a stable steaming, instead of that the water isn't pumped into the boiler until the boiler is lack of water. Usually the quantity of water that can judge that the boiler is lack of water by the cutting of the thermostat is about 10 g.

The method of automatic water-replenishing comprises steps as follows:

(1) comparing the real-time temperature obtained from the temperature sensor with the set point at which the pressure switch is turned off; if the real-time temperature is higher than the set point, step (2) is carried out; if the real-time temperature is lower than the set point no water-replenishing is carried out;

(2) controlling the pump to pump water into the boiler.

Here the signal of the temperature sensor can replace the signal of the thermostat in embodiment 1 directly for detecting the temperature in the boiler and the state of the pressure switch. Namely when there is some water in the boiler, no matter whether the pressure switch is off, the temperature in the boiler can't exceed some temperature such as set temperature of the thermostat; if the temperature arrives at the set temperature that the thermostat is cut off, the temperature sensor will give a signal to the control board, here the state of lack of water of the boiler will be confirmed, and the water can be pumped into the boiler by pumping a relatively small mount of water mulpile times via controlling the pump.

If needed, in water-replenishing step of step (2), the quantity of water-replenishing is calculated by temperature differences between the real-time temperature and the set point firstly, then controlling the pump to make the same amount of water be pumped into the boiler.

A control device of automatic water-replenishing for a boiler iron under the condition of uninterruptible steam, which comprises a normally closed pressure switch that can control power on/off of the boiler according to the pressure in the boiler and a temperature sensor that can sense the temperature of the exterior of the boiler. In the present embodiment the control device is control board, which is used to detect and get the signals of the pressure switch, the thermostat, the NTC and the electromagnetic valve (that is used to control the signal of the control key) and to give orders to control pump. The device at least comprises a judging unit. Wherein the judging unit compares the real-time temperature detected by the temperature sensor with a set point when the pressure switch is off; if the real-time temperature is higher than the set point, controlling the pump to pump water into the boiler, or else water-replenishing is not carried out.

Figure 2:
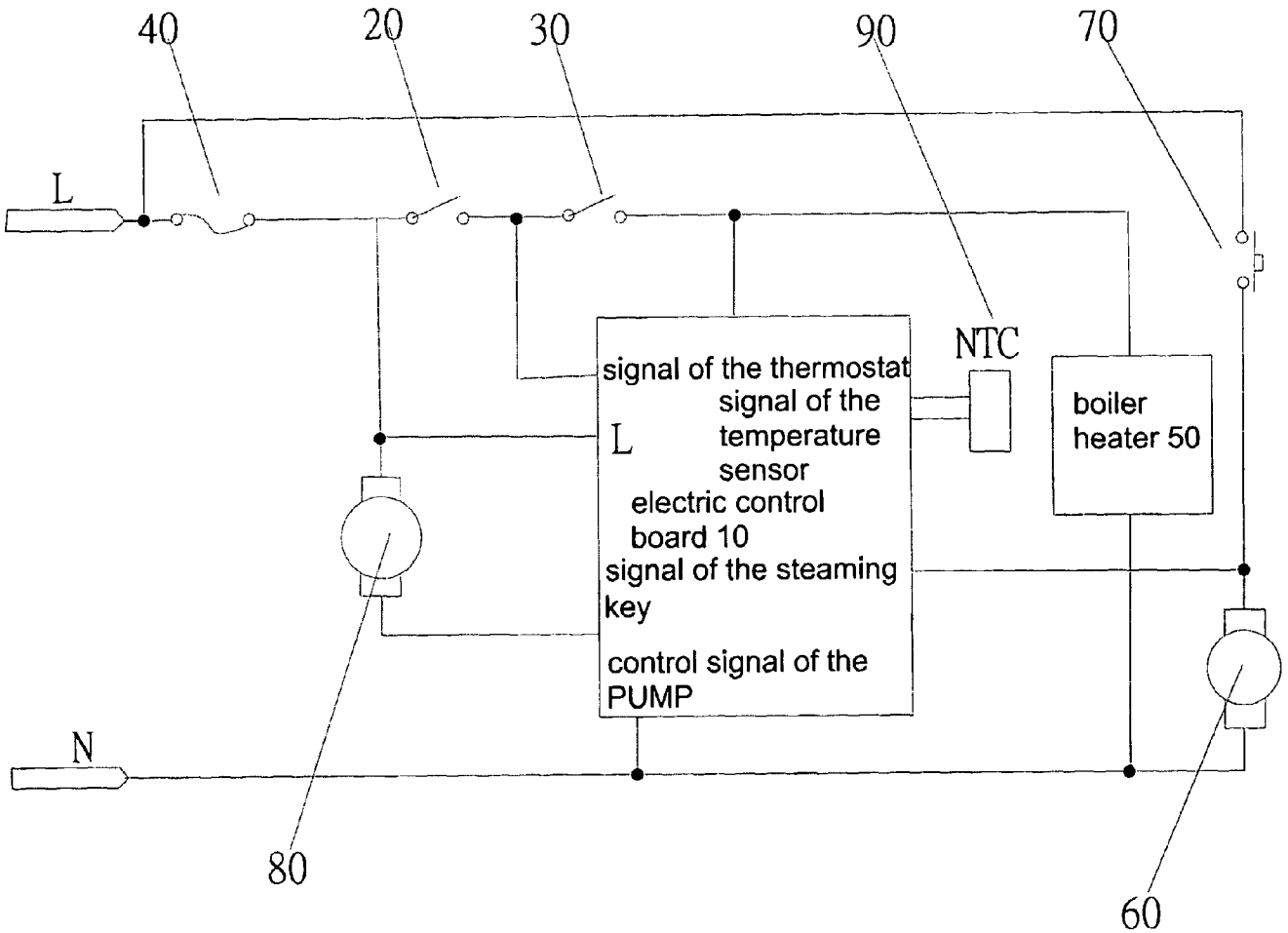
FIG. 2 is a controlling circuit diagram of embodiment 2.

The circuit diagram of above-mentioned boiler can be seen in FIG. 2, which comprises a control board 10, a pressure switch 20, a thermostat switch 30, a fuse 40, a boiler heater 50, an electromagnetic valve 60, a steaming key 70, a pump 80 and a NTC 90. The technicians in the present field can design the detailed circuit without creationary works, so the detailed circuit will not be described.

The foregoing description of the exemplary embodiment of the invention has been presented for the purposes of illustration and description. It is not intended to be exhaustive or to limit the invention to the precise form disclosed. Many modifications and variations are possible in light of the above teaching. All changes that come within the meaning and range of equivalency of the claims are to be embraced within their scope.

What is claimed is:

1. A control method of automatic water-replenishing for a boiler iron under the condition of continuous steaming, which comprises a normally-closed pressure switch that can control power on/off of the boiler according to the pressure in the boiler and a normally-closed thermostat for keeping the boiler in a thermostatic state, the method comprising:

(1) determining whether the thermostat switch is off; if yes, step (3) is carried out, and if no, step (2) is carried out;

(2) detecting whether the steam is needed to be ejected; if yes, opening the electromagnetic valve to eject steam, while at the same time pumping a relatively small amount of water into the boiler by controlling the pump; and (3) controlling the pump to pump a relatively large amount of into the boiler.

2. The control method according to claim 1, wherein in step (2), the quantity of water of pumped into the boiler is slightly less than the quantity of water ejected as steam.

3. The control method according to claim 1, wherein in step (2), the detecting of whether the steam is needed to be ejected is by detecting the signal of the control key of the electromagnetic valve.

4. The control method according to claim 1, wherein in step (3), the water is pumped into the boiler by pumping a relatively small mount of water mulpile times via controlling the pump, to ensure that the replenished water can be adequately vaporized.

5. The control method according to claim 1, wherein the normally-closed pressure switch and the normally-closed thermostat are coupled in such a way that when the temperature and the pressure in the boiler both rise at the same time, the pressure switch is cut off first if needed.

6. A control method of automatic water-replenishing of a boiler iron under the condition of continuous steaming, which comprises a normally-closed pressure switch that can control power on/off of the boiler according to the pressure in the boiler and a temperature sensor that can sense the temperature of the exterior of the boiler, the method comprising the following steps:

(1) comparing the real-time temperature obtained from the temperature sensor with the set point at which the pressure switch is turned off; if the real-time temperature is higher than the set point, step (2) is carried out; if the real-time temperature is lower than the set point no water-replenishing is carried out;

(2) controlling the pump to pump water into the boiler.

7. The control method according to claim 6, wherein in step (2) the pump is controlled to pump a relatively small amount of water into the boiler.

8. The control method according to claims 6 or 7, wherein an amount of water-to be replenished is calculated based on a temperature difference between the real-time temperature and a set point, then the pump is controlled to pump the calculated amount of water into the boiler.

9. A control method of automatic water-replenishing of a boiler iron under the condition of continuous steaming, which comprises a normally-closed pressure switch that can control power on/off of the boiler according to the pressure in the boiler, a normally-closed thermostat for keeping the boiler in a thermostatic state a temperature sensor that can sense the temperature of the exterior of the boiler, wherein the method comprises:

(1) judging whether the thermostat switch is off; if yes, step (4) is carried out, and if no, step (2) is carried out;

(2) comparing the real-time temperature detected by the temperature sensor with a set point when the pressure switch is off; if the real-time temperature is higher than the set point, step (3) is carried out, if the real-time temperature is lower than the set point no water-replenishing is carried out;

(3) controlling the pump to pump water into the boiler;

(4) controlling the pump to pump a relatively large amount of water into the boiler.

10. A control device of automatic water-replenishing for a boiler iron under the condition of uninterruptible steam, which comprises a normally closed pressure switch that can control power on/off of the boiler according to the pressure in the boiler and a normally closed thermostat for keeping the boiler in a thermostatic state, at least comprises a judging unit and a detecting module;

the judging unit is used to judge whether the thermostat switch is off; if yes, controlling the pump to make a relatively large amount of water be pumped into the boiler, or else the detecting module is carried out;

the detecting module is used to detect whether the steam can be ejected; if yes, opening the electromagnetic valve to eject the steam and controlling the pump to make a relatively small amount of water be pumped into the boiler.

11. A control device for automatic water-replenishing of a boiler iron which can operate under the condition of continuous steaming, which comprises a normally-closed pressure switch that can control power on/off of the boiler according to the pressure in the boiler, and a temperature sensor that can sense the temperature of the exterior of the boiler, wherein the control device comprises a judging unit;

wherein the judging unit compares the real-time temperature detected by the temperature sensor with a set point when the pressure switch is off; and wherein if the real-time temperature is higher than the set point, the judging unit controls the pump to pump water into the boiler.

* * * * *